US007036418B2

(12) United States Patent
Greenfield et al.

(10) Patent No.: US 7,036,418 B2
(45) Date of Patent: May 2, 2006

(54) CONTAINER FOR EXPLOSIVE DEVICE

(75) Inventors: Gary Greenfield, San Jose, CA (US); Paul R. Gefken, Mountain View, CA (US); James D. Colton, Palo Alto, CA (US)

(73) Assignee: SRI International, Menlo Park, CA (US)

( * ) Notice: Subject to any disclaimer, the term of this patent is extended or adjusted under 35 U.S.C. 154(b) by 222 days.

(21) Appl. No.: 09/938,444

(22) Filed: Aug. 23, 2001

(65) Prior Publication Data

US 2003/0209133 A1 Nov. 13, 2003

Related U.S. Application Data

(60) Provisional application No. 60/302,235, filed on Jun. 28, 2001.

(51) Int. Cl.
*F42B 39/00* (2006.01)
*F42B 39/24* (2006.01)

(52) U.S. Cl. ..... 86/50; 222/548

(58) Field of Classification Search ..... 86/50, 86/51; 206/3, 772; 220/506, 4.26, 560.01, 220/560.1, 586; 222/544, 548, 553
See application file for complete search history.

(56) References Cited

U.S. PATENT DOCUMENTS

| | | | | |
|---|---|---|---|---|
| 3,820,435 | A * | 6/1974 | Rogers et al. | 89/1.1 |
| 4,027,601 | A | 6/1977 | Hickerson | 109/1 R |
| 4,187,758 | A * | 2/1980 | Petty | 86/50 |
| 4,432,285 | A * | 2/1984 | Boyars et al. | 109/49.5 |
| 4,437,382 | A * | 3/1984 | Yerushalmi | 86/50 |
| 4,836,079 | A * | 6/1989 | Barrett | 86/50 |
| 5,248,055 | A | 9/1993 | Sanai et al. | 220/237 |
| 5,668,342 | A | 9/1997 | Discher | 86/50 |
| 5,684,264 | A * | 11/1997 | Cassells et al. | 89/1.1 |
| 5,864,767 | A | 1/1999 | Drumgoole et al. | 588/202 |
| 5,884,569 | A | 3/1999 | Donovan | 110/346 |
| 6,119,574 | A | 9/2000 | Burky et al. | 89/36.04 |

OTHER PUBLICATIONS

"Portable EOD Total Containment Unit", Nabco, Inc., http://www.nabocinc.com/eod.html, Aug. 10, 2001.

* cited by examiner

*Primary Examiner*—Michael J. Carone
*Assistant Examiner*—Bret Hayes
(74) *Attorney, Agent, or Firm*—Beyer Weaver & Thomas, LLP

(57) ABSTRACT

A container for explosive devices comprising inner and outer containment vessels, each having an access port, is described. The access ports can be rotated in and out of alignment by rotating at least one of the containment vessels. The container serves to enclose, control, and suppress the explosive blast forces, biologically and/or chemically hazardous agents, and fireball resulting from detonation of an explosive device.

22 Claims, 1 Drawing Sheet

CONTAINER FOR EXPLOSIVE DEVICE

CROSS-REFERENCE TO RELATED PATENT APPLICATIONS

This application claims priority from the co-pending U.S. patent application No. 60/302,235 filed Jun. 28, 2001, by Greenfield et al., and titled SPINSAFE—A QUICK ACCESS STORAGE MODULE FOR FULL CONTAINMENT OF EXPLOSIVE BOMBS WITH BIOLOGICAL AND CHEMICAL AGENTS, which is incorporated herein by reference for all purposes.

TECHNICAL FIELD

This invention relates to the containment of explosive devices upon detonation, and, more particularly, to the containment of the explosive blast pressures and fragments together with the containment of biologically and/or chemically hazardous agents or other materials released thereby.

BACKGROUND

Much of the damage associated with explosive devices is related to the fact that a detonation or explosion creates what is known as air shock waves, associated incendiary effects, and high velocity fragments. Air shock is the very high speed initial shock waves in the form of a high amplitude, short duration compressive wave which moves radially outward through the air from the source of the explosion. The incident short-time pressure rise associated with air shock can be on the order of 10–10,000 or more pounds per square inch (psi), depending on the distance to the charge, and consequently can be very devastating to surrounding people and objects. The shock waves heat the air to hundreds or thousands of degrees. Furthermore, duration of this very damaging overpressure may be milliseconds or more, and significant impulse is associated with such a shock wave. Secondary damage is also caused by bomb-generated debris and fragmentation, as well as the hot, expanding bomb gases and particulates known as the fireball.

Many explosive containment systems are primarily designed to mitigate the effects of an explosive blast. For example, the aircraft hardened luggage container system of U.S. Pat. No. 5,267,665 primarily directs the blast forces along noncritical pathways while protecting critical airframe and control components and passenger and crew compartments. Similarly, the explosive storage module (ESM) of U.S. Pat. No. 5,248,055 provides containment of the blast pressure and fragment debris but allows the pressure buildup inside the ESM to be released slowly without causing a significant external airblast. The release of gas pressure from within the ESM is facilitated by the array of quick-lock assemblies located around the periphery of the ESM door. In that ESM, the internal pressure buildup causes the quick-lock bolts to extend slightly, thus generating a gap between the door and the ESM main body.

However, there still remains a need for a quick-access explosive containment device that will contain or suppress an explosion, thus, minimizing the hazards to the surrounding environment from the associated air shock waves, debris, and fireball. There also is a need to contain biologic and chemical agents that can be dispersed by the explosive charge. The present invention addresses these and other needs.

SUMMARY OF INVENTION

This invention relates to the enclosure, control, and suppression of the explosive blast pressures, biologically and/or chemically hazardous agents, and fireball released upon detonation of an explosive device. More specifically, one embodiment of the invention provides a portable, containment unit for use by either military or civilian mobile bomb squads or hazardous materials personnel. In another embodiment, it protects personnel sorting mail or packages or inspecting parcels or luggage at security check points.

The preferred embodiment provides dual containment of explosive products. Specifically, the inner vessel is designed to provide containment of the explosive products while the outer vessel provides backup containment. Containment is achieved through rotating at least one vessel with respect to the other. In one embodiment the vessel can be easily rotated manually to close the containment unit with the simple lever arm. In another embodiment, the vessel can be rotated remotely with a motorized mechanical drive system.

In still another embodiment a lining material, preferably, fragment penetration barrier material, ballistic barrier protection material, or flame retardant material, is positioned within the inner vessel. A filler material, preferably a flame retardant material, and/or a flame arrester, can be positioned between the inner vessel and the outer vessel.

In yet another embodiment, the vessels can be cylindrical, while in still another embodiment the vessels can be spherical. In another embodiment, the invention can be situated in a stationery manner while in yet another, it can be mounted with wheels for portability.

In one embodiment, a gastight seal can be created between the inner and outer vessels. In another embodiment, the unit provides for venting of gas pressure to the atmosphere.

One objective of this invention is to provide a blast containment unit for lessening the damage caused by explosives. Another objective of this invention is to contain bomb fragment debris.

Methods for utilizing the containment units of this invention are also provided.

A further understanding of the nature and advantages of the invention will become apparent by reference to the remaining portions of the specification and drawings.

DETAILED DESCRIPTION OF THE INVENTION

I. General

Figure 1:
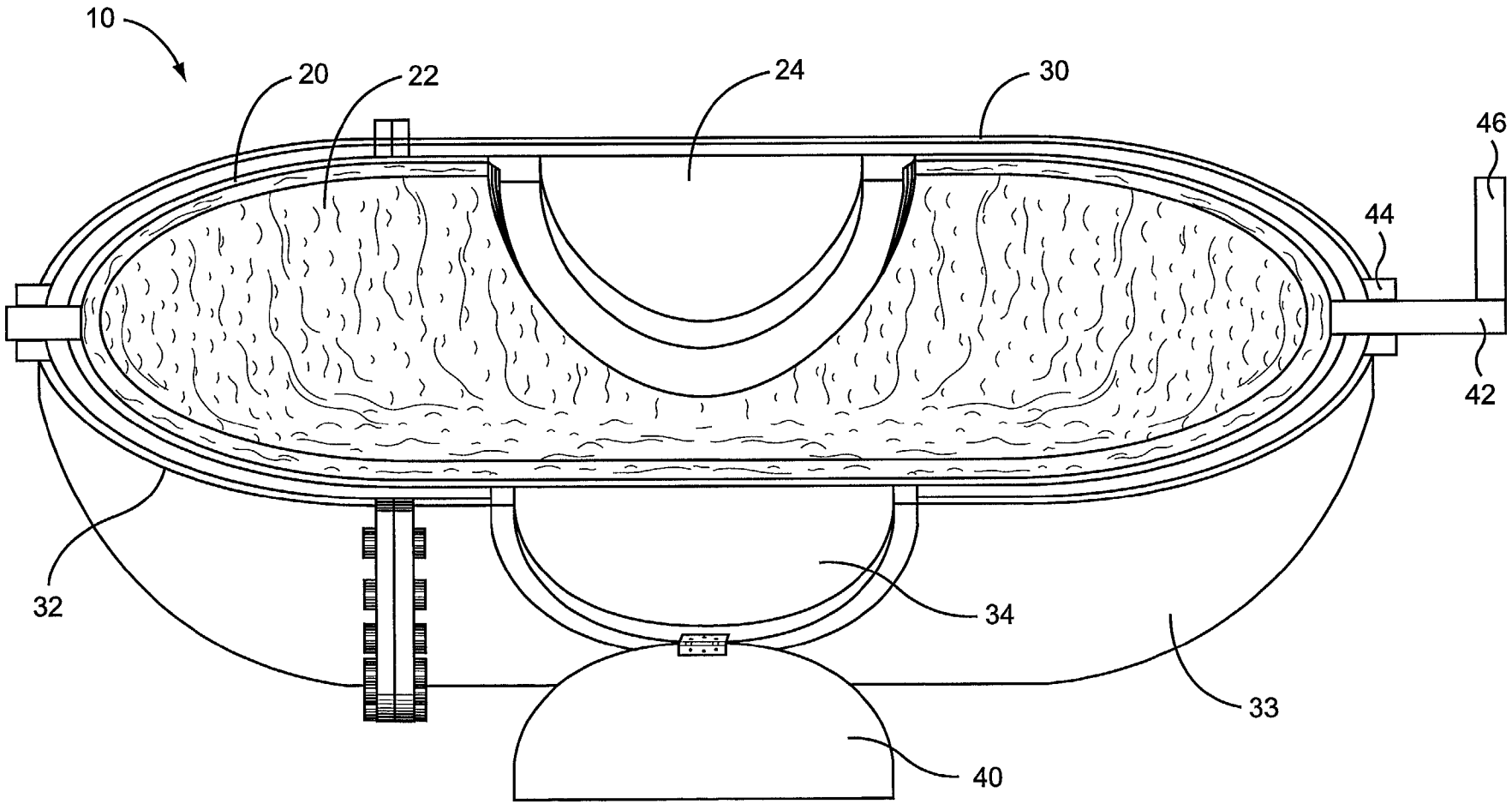
FIG. 1 shows a cross-sectional side view of a containment device in the closed position prepared in accordance with the present invention.

It is to be understood that the terminology used herein is for the purpose of describing particular embodiments only and is not intended to limit the scope of the present invention which will be limited only by the appended claims. It must be noted that as used herein and in the appended claims, the singular forms "a", "an", and "the" include plural reference unless the context clearly dictates otherwise. Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods, devices, and materials are now described.

"Blast", "explosion", and "detonation" are all intended to be interchangeable, unless otherwise defined, and to describe the dynamic, damaging effects of bomb functioning.

"Explosive products" refers to the explosive blast forces, biologically and/or chemically hazardous agents, fireball, and debris released upon detonation of an explosive device.

"Fire-retardant" indicates a reduction or elimination of the tendency of a combustible material to burn, i.e., a "fire-retardant" material is one having a lower ignition susceptibility or, once ignited, lower flammability. See, e.g., National Fire Codes, National Fire Protection Assoc., Quincy, Mass., 1992; Standard Test Method for Heat and Visible Smoke Release Rates for Materials and Products, American Society for Testing and Material, Philadelphia, Pa., 1991; see, also, "Fire Retardants" in Encyclopedia of Polymer Science and Engineering, Vol. 10, page 930–1022, 2nd ed., John Wiley and Sons, NY, 1988).

II. The Containment System

A. The Containment Vessels

A containment unit 10 of this invention is shown in FIG. 1. The overall shape of containment unit 10 may be generally cylindrical (as shown) or spherical.

The containment unit comprises inner (primary) 20 and outer (secondary) containment vessel 30. The inner vessel 20 is designed to provide containment of the products or cargo. The outer vessel 30 provides backup containment.

The wall thickness of inner vessel 20 and outer vessel 30 may vary depending on the overall dimensions, the amount of explosive to be contained, and intended use of containment unit 10. In accordance with a preferred embodiment of the invention, the unit should have an outer diameter not exceeding about four feet and a height not exceeding about six feet, and a wall thickness of not less than about 0.5 inches. Such a containment unit is capable of containing the explosive forces for at least three pounds of Class 1.1 explosives. In a particularly preferred embodiment, outer vessel 30 has an outer diameter of about 30 inches and a height of about 36 inches and inner vessel 20 and outer vessel 30 are constructed of 0.5 inch thick HY80 steel. Units with these dimensions are readily portable through doors and hallways; units of other sizes and shapes can be constructed for other uses.

According to some embodiment of the invention, non-critical sections of the vessels are permitted to deform plastically and may be constructed with a thinner wall. Preferably, critical sections of the vessels will remain elastic.

Containment vessels 20 and 30 are fabricated from materials which may include metals, ceramics, or composite materials such as S-glass, KEVLAR, carbon fiber, Zylon, SPECTRA, from combinations thereof, or from other more advanced materials to reduce cost and weight. For example, the containment vessels may be composed of two aluminum vessels or a combination of inner steel vessel and an outer aluminum vessel wrapped with an inexpensive S-glass high-strength fabric to further reduce the outer vessel weight. According to a particularly preferred embodiment, one or both of the containment vessels is composed of HY80 steel.

According to one embodiment, inner vessel 20 has an inner surface and an outer surface and includes a cylindrical central portion with an end dome on each end, each end dome being permanently affixed to the central portion of the inner vessel.

According to one embodiment, outer vessel 30 has an inner surface and an outer surface and includes a cylindrical central portion, one end dome that is permanently affixed to one end of the central portion and one end dome 32 that is removably secured to the opposite end of the central portion 33. Removal of end dome 32 facilitates placement of inner vessel 20 inside outer vessel 30. Removable end dome 32 is secured to central portion 33 for operation.

According to a particularly preferred embodiment, the end of the central portion 33 and the base of removable end dome 32 are flanged. End dome 32 is bolted or otherwise secured to central portion 33 through the respective flanges or through reinforcing rings positioned around the respective flanges. According to another embodiment, both ends of the central portion have end domes that are removably secured to the central portion of the outer vessel as described above. Alternatively, both end domes can be permanently affixed to the central portion of the outer vessel.

A lining material 22 positioned toward the inner surface of inner vessel 20 ensures that the explosive device will not be placed in contact with the inner surface of inner vessel 20 and preferably supports the explosive device toward the center of the inner vessel. This lining material 22 may also provide an additional fragment penetration barrier to reduce penetration of the inner vessel by the explosive device while not substantially increasing the weight of the containment unit. Such fragment penetration barriers can comprise fabrics, netting or felts made from S-glass, carbon fiber, or other substances; foam; or sand.

According to some embodiments, lining material 22 will comprise a suitable ballistic barrier protection material such as KEVLAR, DYNEEMA, or SPECTRA or other related material that will provide for containment or at least suppression of the hazards due to improvised explosive devices or improvised dissemination devices. These ballistic barrier protection materials have suppressive characteristics that can contain or retard explosively driven fragments and can suppress or contain blast over-pressure.

In a particularly preferred embodiment, lining material 22 will also serve to suppress combustion fireballs resulting from detonation of an explosive device. According to this embodiment, lining material 22 will comprise a fire retardant material.

According to a preferred embodiment, the outer surface of the inner containment vessel 20 is contoured to the inner surface of outer containment vessel 30 with only a small clearance therebetween. In a particularly preferred embodiment, this clearance or gap is filled with a fragment penetration barrier material, ballistic barrier protection material, or fire retardant material as described above. A flame arrester, such as those used in flammable gas systems, can also be placed inside this clearance. Flame arresters serve to break up the flame, preventing the flame from reaching the outside of the unit where they could trigger undesirable combustion of the surroundings, and can further serve to enhance the contact between the flames and the flame retardant materials.

A particularly preferred filler material is one that allows for release or venting of gas pressure and that contains any incendiary materials.

According to some embodiments, a sealing system is used to provide for gas tight operation with no venting to the atmosphere. For example, one or more sets of O-ring seals can be located between the inner vessel and the outer vessel. One O-ring can be located around access port 24 of the inner vessel and seals inner vessel access port 24 against the inside surface of outer vessel 30 for the closed position shown in FIG. 1. A second O-ring can be located between the inner and outer vessels 90 to 180 degrees from the first O-ring and seals outer vessel access port 34 against the outer surface of the inside vessel in the closed position. This positioning of the O-ring seals allows dual containment to be achieved through rotating at least one of the containment vessels from about 90 to about 180 degrees.

Outer vessel 30 can be adapted to rest either on one end or one side, i.e., in a vertical or a horizontal position. Containment unit 10 can be situated in a stationery manner or can be mounted with wheels or robotic tracks for portability.

B. The Closure System

An access port is provided for in each containment vessel, i.e., inner vessel access port 24 and outer vessel access port 34. Generally, the location of the access port may be varied. In a particularly preferred embodiment, the access port will be centrally located along the side of the containment vessel. The size and shape and position of the access port may vary. In a particularly preferred embodiment, each access port will be circular in shape, having a diameter of from about 12 inches to about 18 inches.

In the open condition, the access ports initially line up to provide for insertion of the explosive device into the inner vessel. Rotating one vessel relative to the other moves the ports out of alignment and seals the containment unit. As described further below, the containment unit may be opened by rotating at least one of the containment vessels about a vertical or horizontal axis (depending upon orientation of the unit) to permit objects to be loaded into and removed from the containment unit. Preferably, the vessels rotate within an approximately 180 degree path. It should be understood that other configurations of the access ports are possible, as long as they are selectively positionable between a closed position, in which the containment unit is closed, and an open position, in which explosive devices or other cargo may be placed into or removed from the containment unit.

In a preferred embodiment, stiffener rings or flanges surround the access ports.

According to a preferred embodiment of the invention, the unit further comprises a cover 40, which is attached to outer containment vessel 30, preferably through a hinge. The cover 40 can be secured in a sealing relationship to the access port of the outer vessel 34. The cover 40 is another means to prevent incendiary flame from exiting the unit.

The closure system of the invention provides multiple advantages over conventional inward opening doors on current bomb containment vessels. A major advantage of the containment system described herein is its ease of operation. For example, the containment unit 10 can be closed in a few seconds, and there are no latches to deal with.

Containment unit 10 includes a means for rotating at least one containment vessel with respect to the other to close the containment unit. Accordingly, in one embodiment, inner vessel 20 will rotate with respect to outer vessel 30. Another embodiment provides for rotation of outer vessel 30 with respect to inner vessel 20. A further embodiment provides for rotation of both vessels in a cooperative manner.

Preferably, the rotating means can be activated with a low amount of force. Such activation can be accomplished manually or through a motor-driven, pneumatic or hydraulic mechanism. One embodiment of the invention provides for remote activation 36 with a motorized mechanical drive system 38. Preferably, the rotating means will withstand significant dynamic and static loads within a hostile environment.

Rotation may be further facilitated through the use of one or more radial bearings and one or more thrust bearings to carry the weight of the rotating vessel and its contents. Other rotating means include pneumatic or hydraulic mechanisms as are known in the art.

A particularly preferred rotating means comprises the use of a simple lever. According to one embodiment, the apex of an end dome of the inner containment vessels is affixed to one end of a rotatable shaft 42 that extends through a bushing 44 in outer vessel 30. This rotatable shaft 42 generally will range in diameter from about one inch to about four inches. The other end of rotatable shaft 42 is affixed to a lever arm 46. When a slight pressure is applied to lever arm 46, shaft 42 rotates which in turn rotates at least one of the containment vessels, thus closing the containment unit.

According to another embodiment, the apex of an end dome of outer containment vessel is affixed to a lever arm. When a slight pressure is applied to the lever arm, outer vessel 30 rotates, thus closing the containment unit.

It will be readily appreciated that, when the unit is to be operated in a horizontal position, it may be desirable to include rotating means on both ends of the unit. In one embodiment, the apex of each end dome of the inner vessel is affixed to first and second rotatable shafts, respectively, each extending through bushings in outer vessel 30. Both shafts are affixed to lever arms. When pressure is applied to one or both of the lever arms, the shafts will cooperatively rotate, thus closing the containment unit. In another embodiment, the apex of each end dome of the outer vessel are affixed to lever arms. When pressure is applied to one or both lever arms, the vessel will rotate, thus, closing the containment unit.

In another embodiment, one lever arm is affixed to the outer vessel and one lever arm is affixed to the inner vessel, each as described above. When pressure is applied to one or both lever arms, the vessel will rotate, thus, closing the containment unit.

According to a particularly preferred embodiment, the containment unit will further comprise a means to stop rotation, thus, preventing over rotation of the inner unit. This can be accomplished either through a mechanical stop or by designing the flanges around the access ports so that they wedge against each other in the closed position.

C. Operation

According to one aspect of the invention, the containment system is configured so as to be reusable. According to another aspect of the invention, the containment system is designed for one-time use.

One aspect of the invention provides for a self-venting containment system wherein the gas pressure within the inner containment vessel is allowed to gradually dissipate into the environment.

Other aspects of the invention provide for a sealed containment system that allows for containment of explosive products. According to this embodiment, the explosive device can be disrupted inside the sealed containment unit, and then the inner unit can be decontaminated and flushed. In some cases, the the container includes one or more access valves 48, which permit sampling ofpost-detonation contents of the container for purpose of analysis. Samples of the interior atmosphere can be taken to determine the appropriate treatment to verify the decontamination process was successful. According to these embodiments, the unit further comprises a drain post with shut off valve; purge port for flooding the unit with decontamination material; sample post for testing internal atmosphere pre and post detonation.

According to some embodiments, the unit further comprises a countercharge and/or a detonation interface that directs a plurality of energies or fields, including electromagnetic, electrostatic, magnetic, or acoustic toward the cargo thereby inducing detonation. See, U.S. Pat. No. 5,668,342. Alternatively, the cargo can be allowed to detonate on its own.

Because the containment system is completely functional in either a horizontal or vertical position, it provides extra flexibility for incorporation into existing screening operations for packages or baggage at post offices or airports. The containment system can be used adjacent to or part of a package screening table or conveyer belt system. For low-level conveyer belts a few feet off the ground, the containment system can be placed in a cavity in the floor so that the access port is at the conveyer belt level. The containment system is also easily portable when placed on a cart with caster wheels. Thus, it is ideal for use by bomb squads.

The preferred embodiment provides dual containment of explosive products. A containment unit of the present invention has been tested with about three pounds of explosive material. Strain on the unit was actively and passively measured. Small areas of plasticity were found in a few localized locations. The blast resulted in no permanent deformations and the unit was found to be operational for repeat use.

The references discussed herein are provided solely for their disclosure prior to the filing date of the present application and are each incorporated herein by reference. Nothing herein is to be construed as an admission that the inventors are not entitled to antedate such disclosure by virtue of prior invention.

Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes are carrying out the invention which are obvious to those skilled in the art are intended to be within the scope of the following claims.

What is claimed is:

1. A container for an explosive device comprising:

an outer containment vessel, resting either on one end or one side, said outer containment vessel including a single outer access port for allowing entrance or egress of the explosive device;

an inner containment vessel positioned completely within said outer vessel, said inner containment vessel including an inner access port;

a means for lining the inner containment vessel such that the explosive device is at least partially suspended within the inner containment vessel, wherein the means for lining is disposed within the inner containment vessel; and a means for rotating at least one vessel with respect to the other;

wherein engagement of said rotating means causes at least one of said containment vessels to rotate from a position wherein said inner access port is aligned with said single outer access port to a position wherein said inner access port has been rotated from about 90 to about 180 degrees with respect to said single outer access port such that debris, blast pressure, and fireball from explosion of the explosive device within said inner vessel are safely contained or mitigated.

2. The container of claim 1, wherein the outer surface of said inner containment vessel is contoured to the inner surface of said outer containment vessel with a small clearance therebetween.

3. The container of claim 2, wherein a filler material is inserted into said clearance.

4. The container of claim 3, wherein said filler material is flame retardant.

5. The container of claim 1, wherein the outer containment vessel comprises a central portion and an end dome, wherein said end dome is removably secured to the central portion.

6. The container of claim 1 further comprising a cover for said outer access port.

7. The container of claim 6, wherein said cover is flame retardant.

8. The container of claim 1, wherein said inner containment vessel further comprises a lining material.

9. The container of claim 8, wherein said lining material supports an explosive device toward the center of the inner vessel.

10. The container of claim 8, wherein said lining material is flame retardant.

11. The container of claim 1, wherein said outer containment vessel is spherical.

12. The container of claim 1, wherein said outer containment vessel is cylindrical.

13. The container of claim 1, wherein said rotating means comprise a lever arm attached to said inner containment vessel, wherein an engagement of said lever arm causes said inner containment vessel to rotate from a position wherein said inner access port is aligned with said outer access port to a position wherein said inner access port has been rotated from about 90 to about 180 degrees with respect to said outer access port.

14. The container of claim 13, wherein said rotating means is activated remotely.

15. The container of claim 14, wherein said rotating means is a motorized mechanical drive system.

16. The container of claim 1, further comprising a scaling means provided between said outer containment vessel and said inner containment vessel such that chemical or biological agents to be dispersed are sealed within the unit container prior to the explosion.

17. The container of claim 1, further comprising one or more access valves which permit sampling post-detonation contents of the container for purposes of analysis.

18. A method of suppressing blast effects associated with detonation of an explosive device, said method comprising the steps of:

inserting said explosive device into a blast container comprising a–d, said a–d comprising:

(a) an outer containment vessel, resting either on one end or one side, said outer containment vessel including a single outer access port for allowing entrance or egress of the explosive device;

(b) an inner containment vessel positioned completely within said outer vessel, said inner containment vessel including an inner access port;

(c) a means for lining the inner containment vessel such that the explosive device is at least partially suspended within the inner containment vessel, wherein the means for lining is disposed within the inner containment vessel; and (d) a means for rotating at least one vessel with respect to the other, engaging said rotating means;

wherein engagement of said rotating means causes at least one of said containment vessels to rotate from a position wherein said inner access port is aligned with said outer access port to a position wherein said inner access port has been rotated from about 90 to about 180 degrees with respect to said single outer access port such that debris, blast pressure, and fireball from explosion of the explosive device within said inner vessel are safely contained or mitigated.

19. A container for an explosive device comprising;

an outer containment vessel, adapted to rest either on one end or one side, said outer containment vessel including a single outer access port for allowing entrance or egress of the explosive device;

an inner containment vessel positioned completely within said outer vessel, said inner containment vessel including an inner access port;

one or more access valves which permit sampling post-detonation contents of the container for purposes of analysis;

a suspension mechanism for suspending the explosive device within said inner containment vessel;

a rotation mechanism for rotating at least one vessel with respect to the other; wherein engagement of said rotation mechanism causes at least one of said containment vessels to rotate from a position wherein said inner access port is aligned with said outer access port to a position wherein said inner access port has been rotated from about 90 to about 180 degrees with respect to said single outer access port such that debris, blast pressure, and fireball from explosion of the explosive device within said inner vessel are safely contained or mitigated; and a sealing means comprising an annular seal disposed between and in communication with both the outer containment vessel and the inner containment vessel said sealing means engaged when the inner access port has been rotated from about 90 to about 180 degrees with respect to the single outer access port.

20. The container of claim 19, wherein chemical or biological agents to be dispersed are completely contained within the unit.

21. The container of claim 19, wherein the annular seal is circular in cross-section.

22. A container for an explosive device comprising:

an outer containment vessel including a single outer access port for allowing entrance or egress of the explosive device;

an inner containment vessel positioned completely within said outer vessel, said inner containment vessel including an inner access port;

a lining for the inner containment vessel, disposed within the inner containment vessel, for at least partially suspending the explosive device within the inner containment vessel; and a rotation mechanism for rotating the outer containment vessel relative to the inner containment vessel wherein engagement of said rotation mechanism causes at least one of said containment vessels to rotate from a position wherein said inner access port is aligned with said single outer access port to a position wherein said inner access port has been rotated from about 90 to about 180 degrees with respect to said single outer access port such that debris, blast pressure, and fireball from explosion of the explosive device within said inner vessel are safely contained or mitigated.

* * * * *